US007865969B2

(12) United States Patent
Auger et al.

(10) Patent No.: US 7,865,969 B2
(45) Date of Patent: Jan. 11, 2011

(54) VIBRATION DAMPING DEVICE FOR GLOVE

(75) Inventors: Michel J. G. Auger, Belleville (CA); Douglas C. Doolittle, Frankford (CA)

(73) Assignee: Impacto Protective Products Inc., Belleville, Ontario (CA)

( * ) Notice: Subject to any disclaimer, the term of this patent is extended or adjusted under 35 U.S.C. 154(b) by 1268 days.

(21) Appl. No.: 11/048,903

(22) Filed: Feb. 3, 2005

(65) Prior Publication Data

US 2006/0168706 A1 Aug. 3, 2006

(51) Int. Cl.
*A41D 13/00* (2006.01)

(52) U.S. Cl. ..... 2/20; 2/160; 2/161.7

(58) Field of Classification Search ..... 2/16, 2/20, 158, 159, 160, 161.1, 161.5, 161.6; 36/141, 154, 153; 602/21
See application file for complete search history.

(56) References Cited

U.S. PATENT DOCUMENTS 3,098,563 A * 7/1963 Skees ..... 2/458
3,142,599 A * 7/1964 Chavannes ..... 156/210
3,231,454 A * 1/1966 Williams ..... 428/132
3,404,406 A * 10/1968 Balliet ..... 2/2.16
3,640,831 A * 2/1972 Gardner et al. ..... 428/72
3,757,774 A * 9/1973 Hatuno ..... 601/28
3,771,170 A * 11/1973 Leon ..... 2/97
4,344,536 A * 8/1982 Oberhuber ..... 206/594
4,471,538 A * 9/1984 Pomeranz et al. ..... 36/28
4,745,635 A * 5/1988 Kinnear ..... 2/161.6
4,785,479 A * 11/1988 Watanabe ..... 2/163
4,831,749 A * 5/1989 Tsai ..... 36/3 B
5,140,721 A * 8/1992 Kauffeld ..... 2/2.16
5,193,246 A * 3/1993 Huang ..... 16/421
5,274,846 A * 1/1994 Kolsky ..... 2/460
5,537,688 A 7/1996 Reynolds et al.
5,771,490 A 6/1998 Reynolds et al.
6,202,217 B1 3/2001 Karall
6,289,524 B1 9/2001 Wright et al.
6,591,456 B2 * 7/2003 DeLuca et al. ..... 16/431
6,682,128 B2 * 1/2004 Carroll et al. ..... 296/187.03
6,928,658 B2 * 8/2005 Taira et al. ..... 2/161.6
2004/0226074 A1 * 11/2004 Taira et al. ..... 2/159

FOREIGN PATENT DOCUMENTS

JP 2000245808 A * 9/2000

* cited by examiner

*Primary Examiner*—Gary L Welch
*Assistant Examiner*—Sally C Cline
(74) *Attorney, Agent, or Firm*—George A. Seaby

(57) ABSTRACT

A vibration damping device for use in a work glove includes a planar plastic body having palm, thumb and finger areas, and a plurality of resilient, compressible projections extending outwardly from at least one surface of the body. Planar areas or webs in the knuckle and finger joint areas of the body make the device flexible for easy grasping of a tool and bunching of projections in such areas. Bunching of the projections is also avoided or reduced by arranging the projections in parallel, arcuate rows extending from the thumb side rearwardly toward the wrist end of the body.

7 Claims, 1 Drawing Sheet

VIBRATION DAMPING DEVICE FOR GLOVE

BACKGROUND OF THE INVENTION

1. Field of the Invention

This invention relates to a vibration damping device, and in particular to vibration damping device for use in a work glove.

2. Discussion of the Prior Art

Vibration damping devices have been used for some time in gloves worn by persons manually operating vibrating tools such as jackhammers and compactors. Examples of such devices are described in U.S. Pat. No. 5,537,688 (Reynolds), U.S. Pat. No. 5,771,490 (Reynolds) and U.S. Pat. No. 6,202,217 (Karall). While such devices are more or less effective in damping vibrations, a problem with existing devices involves flexibility and comfort, particularly in the palm area of the hand. Some devices of the type in question include a plurality of pockets containing air or another compressible fluid. When the pockets are interconnected, during use of a glove containing the bladder, air can be forced out of an area under maximum pressure, thereby reducing the damping effect of the bladder in the area where it is most required. When a plurality of separate, individual cells or pockets, or individual resilient projections separated by grooves are used in the damping device, there is a tendency for the cells or projections to bunch in the area of the palm when the hand grasps a piece of equipment.

GENERAL DESCRIPTION OF THE INVENTION

The object of the present invention is to provide a solution to the above-identified problems in the form of a vibration damping device for use in a glove which reduces or eliminates bunching of cells or projections in the palm, thumb and finger areas of a glove, and which is relatively flexible.

Accordingly, the invention relates to a vibration damping device for use in a work glove comprising a planar, hand-shaped body including a top surface, a bottom surface, a palm area, finger areas extending forwardly from one end of the palm area, and a thumb area contiguous with one side of the palm area; a plurality of discrete, spaced apart, resilient, vibration damping projections extending outwardly from at least one said surface of said body; first planar, projection-free webs between said palm area and said finger areas; and second planar, projection-free webs defining flexible joints in said thumb and finger areas.

BRIEF DESCRIPTION OF THE DRAWINGS

The invention is described below in greater detail with reference to the accompanying drawings, which illustrate a preferred embodiment of the invention, and wherein.

DESCRIPTION OF THE PREFERRED EMBODIMENT

Figure 3:
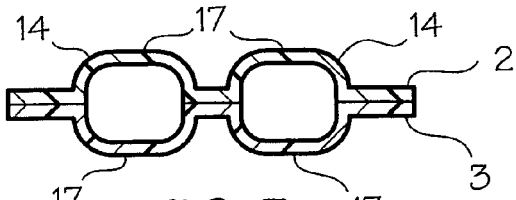
FIG. 3 is a cross section taken generally along line 3-3 of FIG. 1 on a larger scale than FIGS. 1 and 2.

Referring to the drawing, the damping device of the present invention includes a planar body 1 formed of two layers 2 and 3 (FIG. 3) of 0.8-1.0 mm thick polyurethane film. The two layers 2 and 3 are mirror images of each other and have roughly the shape of a hand including a palm area 4, a thumb area 5 and four finger areas 6. The thumb area 5 extends rearwardly from one end of the palm area 4, and the four finger areas 6 extend forwardly from the opposite end of the palm area. Thus, a single damping device can be used in right and left gloves. The front or finger end 7 of the palm area 5 defines an arc, which curves rearwardly from the index finger side to the little finger side of the body. When placed in a work glove (not shown), the thumb area 5 is attached to the thumb portion of the glove to oppose the index finger. The thumb area 5 and the fingers 6 include opposed notches 8 and 9, respectively for facilitating bending of the damping device in the areas of the thumb and finger joints of a glove containing the damping device. Similarly, notches 11 are provided in areas between the palm area 4 and the adjacent inner ends of the finger areas 6 facilitating bending of the user's knuckles.

A plurality of cells 12, 13 and 14 are provided in the palm, thumb and finger areas 4, 5 and 6, respectively of the body. However, there are no cells in the areas between the notches 8 in the thumb area 5, between the notches 9 in the finger areas 6 of the body and between the notches 11 at the junction between the palm and finger areas, i.e. there are thin, planar webs 15 and 16 in the knuckle area, and in the thumb and finger joint areas, respectively of the device. The thin, planar webs 15 and 16 make the flexibility of the device greater than if cells were provided over the entire area of the body, and prevent bunching of cells in the knuckle, and thumb and finger joint areas of the device.

When producing the device, two planar blanks of the two layers 2 and 3 of the body are subjected to vacuum molding to produce depressions 17 (FIG. 3) in one side thereof. The two layers 2 and 3 are fused together in all areas between and around the depressions 17 to form discrete, resilient cells. The cells 12 in the palm area 4 are arranged in arcuate, parallel rows. The first five rows of cells 12 in the palm area 4 extend from points adjacent the inner side 18 of the palm area 4 closest to the thumb area toward the rear, free or wrist end 19 of the palm area. Successive rows of the cells 12 are roughly parallel to the first row nearest the wrist end of the body.

Figure 1:
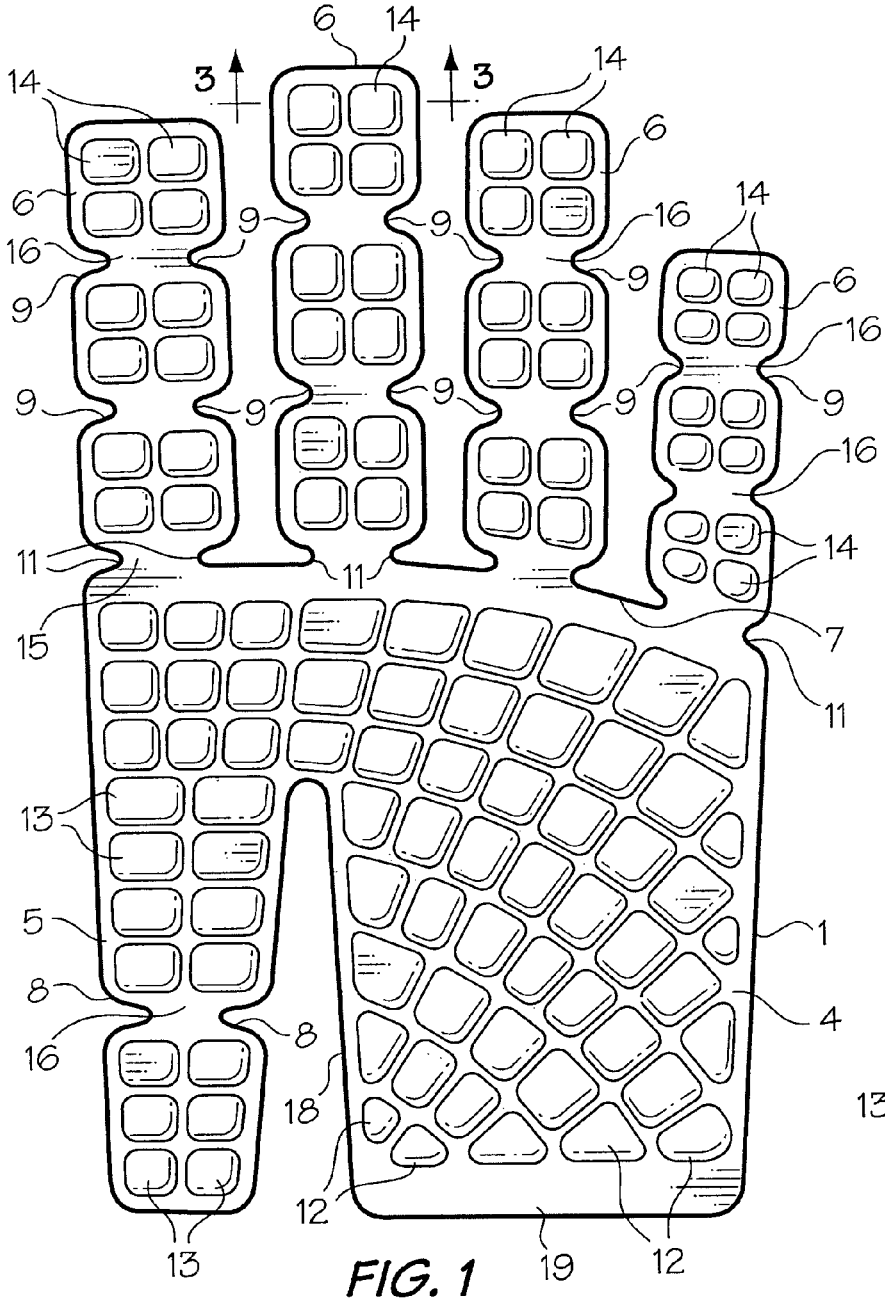
FIG. 1 is a front view of a vibration damping device in accordance with the present invention.
Figure 2:
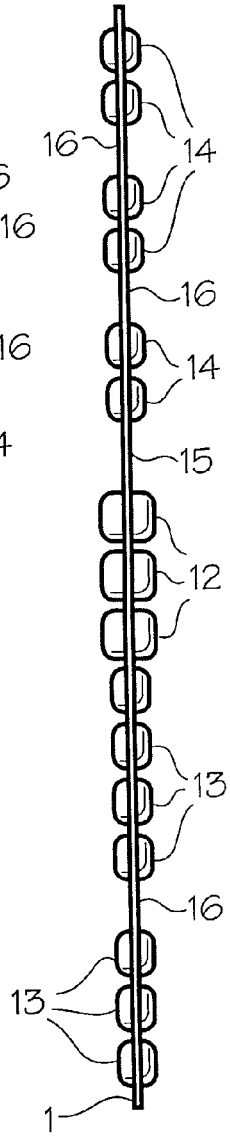
FIG. 2 is a schematic side view of the device of FIG. 1.

As clearly illustrated in FIG. 1, the length of the web 15, i.e. the distance between the cells 12 at the top end of the palm area 4 and the nearest cells 14 in the finger areas is greater than the spacing between adjacent cells 12 and 14 in the palm area 4 and the finger areas 6, respectively. Likewise, the length of each web 16 in the thumb area 5 and the finger areas 6 is greater than the spacing between the adjacent cells 13 and 14 in such areas 5 and 6, respectively.

It has been found that the particular arrangement of cells 12 defining arcs in the palm area 4 reduce bunching in the palm area. Moreover, as mentioned above, the cell-free webs 15 and 16 at the junction between the palm area 4 and the finger areas 6, and in the thumb and finger areas roughly matching the areas of a user's knuckles, and thumb and finger joints, respectively lead to greater flexibility of a glove containing the device. The cells described above are air filled. However, it will be appreciated by those skilled in the art to which the invention relates that the cells can contain another compressible fluid, or be replaced by other resilient, shock absorbing, vibration damping projections. Moreover, while the cells or projections in the preferred embodiment of the invention extend outwardly from both surfaces of the body, while not as effective, the vibration damping cells or projections could extend outwardly from only one surface of the device.

The invention claimed is:

1. A vibration damping device for use in a work glove comprising a planar, hand-shaped body formed of two layers of film, said body including a top surface, a bottom surface, a palm area, finger areas extending forwardly from one end of the palm area, and a thumb area contiguous with one side of the palm area; a plurality of discrete, spaced apart, resilient, vibration damping projections extending outwardly from both top and bottom surfaces of said body; a first flat, planar, projection-free web extending completely across the body between said palm area and said finger areas, said first web extending into said palm and finger areas; and second planar, projection-free webs extending completely across each thumb and finger area, the two layers of film in the areas of said first and second webs being sealed together, the first and second webs having parallel top and bottom surfaces, and each of the webs having a length which is greater than the spacing between adjacent projections in the palm, finger and thumb areas, whereby the webs define flexible joints between said palm and finger areas and in said thumb and finger areas.

2. The vibration damping device of claim 1, including notches in side edges of the body at ends of said first web and in side edges of said finger and thumb areas of the body at ends of said second webs for increasing the flexibility of the body.

3. The vibration damping device of claim 1, wherein said vibration damping projections are compressible fluid containing cells.

4. The vibration damping device of claim 1, wherein said projections in said palm area define arcuate rows extending rearwardly from said one side of the palm area towards a second, wrist end of the palm area.

5. A vibration damping device for use in a work glove comprising a planar, hand-shaped body formed of two layers of film, said body including a top surface, a bottom surface, a palm area, finger areas extending forwardly from one end of the palm area, and a thumb area contiguous with one side of the palm area; a plurality of discrete, spaced apart, resilient, vibration damping projections extending outwardly from both top and bottom surfaces of said body, said projections in said palm area defining arcuate rows extending rearwardly from said one side of the palm area towards a second, wrist end of the body; a first flat, planar, projection-free web extending completely across the body between said palm area and said finger areas, said first web extending into said palm and finger areas; and second planar, projection-free webs extending completely across each thumb and finger area, the two layers of film in the areas of the first and second webs being sealed together, the first and second webs having parallel top and bottom surfaces, and each of the webs having a length which is greater than the spacing between the adjacent projections in the palm, finger and thumb areas whereby the webs define flexible joints between said palm and finger areas and in said thumb and finger areas.

6. The vibration damping device of claim 5, including notches in side edges of the body at the ends of said first web and in ends of said second webs at side edges of said finger and thumb areas of the body for increasing the flexibility of the body.

7. The vibration damping device of claim 5, wherein said vibration damping projections are compressible fluid containing cells.

* * * * *